US009155345B2

(12) United States Patent
Nisim et al.

(10) Patent No.: US 9,155,345 B2
(45) Date of Patent: Oct. 13, 2015

(54) REMOVAL SYSTEM FOR SEWN-IN HAIR EXTENSIONS, HAIR WEAVES, HAIR AUGMENTATION, AND WIGS

(71) Applicants: Vered Nisim, Beverly Hills, CA (US); Melvin Phillips, Los Angeles, CA (US); Olander Ellis, Los Angeles, CA (US)

(72) Inventors: Vered Nisim, Beverly Hills, CA (US); Melvin Phillips, Los Angeles, CA (US); Olander Ellis, Los Angeles, CA (US)

( * ) Notice: Subject to any disclaimer, the term of this patent is extended or adjusted under 35 U.S.C. 154(b) by 0 days.

(21) Appl. No.: 14/317,506

(22) Filed: Jun. 27, 2014

(65) Prior Publication Data

US 2015/0007847 A1 Jan. 8, 2015

Related U.S. Application Data

(60) Provisional application No. 61/843,143, filed on Jul. 5, 2013.

(51) Int. Cl.
*A41G 3/00* (2006.01)
*A41G 5/00* (2006.01)

(52) U.S. Cl.
CPC ..... *A41G 5/006* (2013.01); *A41G 5/0086* (2013.01); *A41G 5/004* (2013.01)

(58) Field of Classification Search
CPC ..... A41G 5/00; A41G 5/0013; A41G 5/002; A41G 5/004; A41G 5/0053; A41G 5/006; A41G 5/0086; A61B 17/01166
USPC ..... 132/201
See application file for complete search history.

(56) References Cited

U.S. PATENT DOCUMENTS

| | | | | |
|---|---|---|---|---|
| 2,638,102 | A * | 5/1953 | Goldsmith | 132/274 |
| 3,382,607 | A * | 5/1968 | Ryan et al. | 446/296 |
| 2005/0267532 | A1* | 12/2005 | Wu | 606/228 |
| 2008/0196732 | A1* | 8/2008 | Merszei | 132/201 |
| 2011/0079235 | A1* | 4/2011 | Reed | 132/200 |
| 2013/0180541 | A1* | 7/2013 | Bobinac | 132/203 |

* cited by examiner

*Primary Examiner* — Robyn Doan

(57) ABSTRACT

A removal system for sewn-in hair extensions, hair weaves, hair augmentation, and wigs is disclosed. This invention solves issues with respect to facile removal and scalp irritation caused by such extensions through the use of methods using dissolvable thread and dissolving agent, with optional added antipruritic and anti-itch properties or by adding a separate antipruritic agent. The dissolvable thread may be used to either secure hair extension wefts to a wearer's hair or in conjunction with a hair weft constructed of the same dissolvable material comprising the thread.

20 Claims, 10 Drawing Sheets

A (Braided Thread)

B (Coated Braided Thread)

REMOVAL SYSTEM FOR SEWN-IN HAIR EXTENSIONS, HAIR WEAVES, HAIR AUGMENTATION, AND WIGS

CROSS REFERENCE TO RELATED APPLICATION

This application claims benefit under 35 U.S.C. §119(e) to U.S. Provisional Application No. 61/843,143, filed Jul. 5, 2013, which is incorporated by reference herein in its entirety.

BACKGROUND OF THE INVENTION

1. Field of the Invention

The present invention relates generally to hair weft extensions and methods of securing same, and more particularly to providing a hair weft with a dissolvable thread which secures the weft to natural hair or wig caps for extending the length of the natural hair and enhancing the fullness of the hair on a individual's head, where such dissolvable thread allows for facile removal of such hair weft extensions.

2. Background Information

The amount of time and effort spent in the removal of sewn-in hair extensions, hair weaves, hair augmentation, or wigs from the person's natural hair is tedious and lengthy. Cutting instruments utilized in this task invariably result in the unintentional cutting of some of the wearer's own natural hair.

Using cutting instruments to remove hair extensions, such as scissors or knives, often presents the risk of mistakenly cutting one's own natural hair, or sustaining cutting injuries altogether. Further, the vast majority of people wearing previously installed hair extensions continuously experience itching from such extensions.

The methods and compositions disclosed herein solve both of those issues through the use of dissolvable thread and dissolving agent, with added antipruritic and anti-itch properties, thus providing consistent comfort to the wearer. The dissolvable thread may be used to either secure hair extension wefts to a wearer's hair or in conjunction with a hair weft constructed of the same materials of which the dissolvable thread is constructed.

SUMMARY OF THE INVENTION

The present invention relates to a quick removal system for sewn-in hair extensions, hair weaves, hair augmentation, and wigs.

In embodiments, an artificial hair integration article is disclosed including a hair extension weft and a dissolvable thread interwoven through one or more positions along the length of a seam of the hair extension weft, where the dissolvable thread removably attaches the weft to a section of natural hair or a wig cap on the head of an individual.

In one aspect, the dissolvable thread is insoluble in water, shampoo containing aqueous bases or organic solvents, or combinations thereof, and the interwoven dissolvable thread is optionally secured to at least one end of said weft seam by one or more knots.

In another aspect, the dissolvable thread is interwoven through the natural hair or wig cap at positions along the seam to secure the weft to the head of an individual.

In a further aspect, the dissolvable thread comprises a linear or branched polysaccharide. In a related aspect, the linear polysaccharide is a chitosan.

In one aspect, the weft comprises natural hair, synthetic fibers or a combination thereof. In a related aspect, the synthetic fibers and dissolvable thread comprise the same material.

In another aspect, the rate at which the thread dissolves is dependent on the degree of acetylation (DA) of the chitosan. In a related aspect, the DA of the chitosan is between about 2% to about 10%, and the dissolvable thread may be removed from the weft, natural hair or wig cap by application of an acid with a pKa of less than about 6.2.

In another embodiment, a method of removing one or more artificial hair integration articles from the head of an individual is disclosed, where the individual has at least one hair extension weft secured to the natural hair or wig cap on the head of thereof via a dissolvable thread interwoven through one or more positions along the length of a seam of the at least one hair extension weft, including, as an option, applying an antipruritic agent along the length of the seam; applying a dissolving agent along the length of the seam; and pulling or combing-out the hair extension wefts as the dissolvable threads dissolve; where the applying, pulling and combing steps may be repeated until all of the at least one artificial hair integration articles are removed, and where the dissolvable thread includes chitosan.

In one aspect, the dissolving agent optionally includes an antipruritic agent.

In another aspect, the pulling or combing step optionally includes the application of a thread removal tool, which thread removal tool has a handle and a sharp curved inner edge blade at one end of the handle, where the curved inner edge blade is housed within a non-sharp outer edge and blunt tip. In a related aspect, the method may include inserting the blunt tip of the tool into the seam of the hair extension weft to isolate the dissolving thread; twisting the curved inner edge cutting blade up to hook the dissolving thread; pulling the hooked thread either back or upwards, or cutting the thread bi-directionally, where the pulling or cutting disengages the dissolving thread from the hair extensions weft and repeating these steps to gently pull or comb-out hair extensions as thread is disengaged.

In another aspect, the method may include rinsing the head of the individual to remove the antipruritic agent and the dissolving agent.

In one aspect, the antipruritic agent is applied as an aerosol, foam, cream, gel, or liquid. In another aspect, the dissolving agent is applied as an aerosol, foam, cream, gel, or liquid.

In one embodiment, a kit for applying to and removing an artificial hair integration article from the head of an individual is disclosed including at least one hair extension weft; a spool of dissolvable thread for interweaving through one or more positions along the length of a seam of the hair extension weft; a dissolving agent, where the agent dissolves the thread; optionally an antipruritic agent; a first set of containers for the agents; instructions; and one or more labels.

In one aspect, the dissolvable thread includes chitosan.

In another aspect, the agents may be in the form of an aerosol, foam, cream, gel, or liquid, or a combination thereof.

In one aspect, the kit further includes a thread removal tool, which thread removal tool includes a handle and a sharp curved inner edge blade at one end of the handle, where the curved inner edge blade is housed within a non-sharp outer edge and blunt-tip.

DETAILED DESCRIPTION OF THE INVENTION

Figure 1:
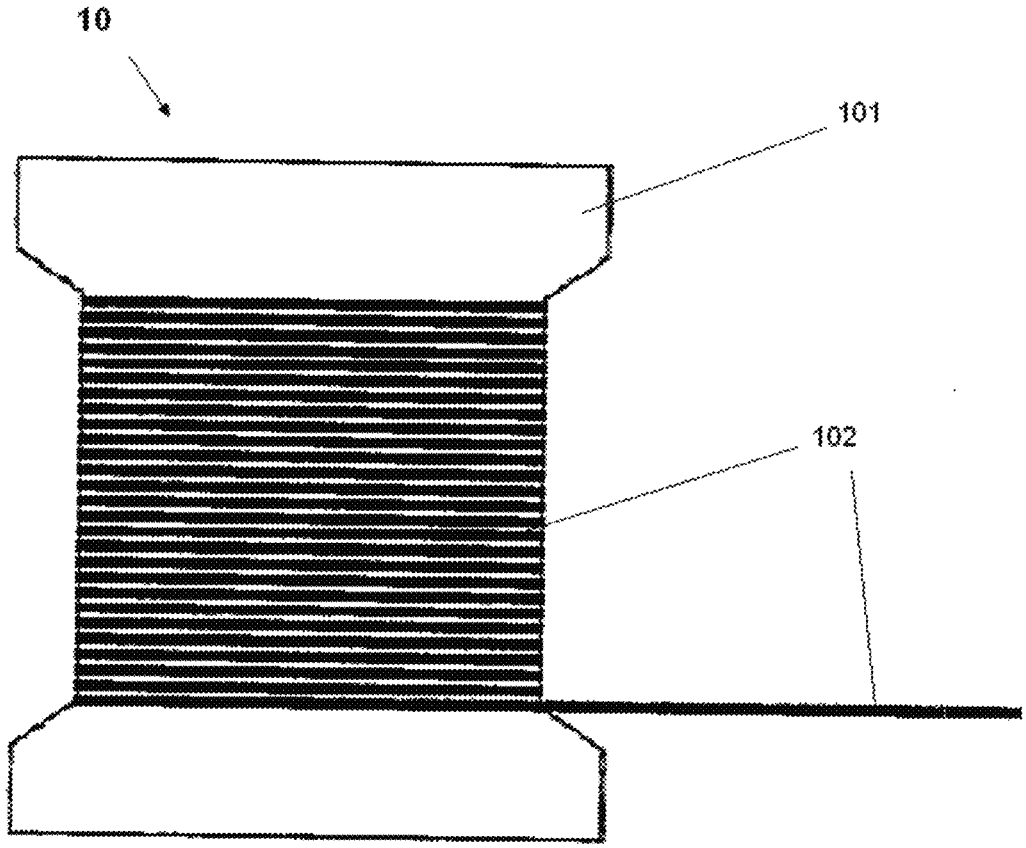
FIG. 1 shows dissolvable thread which secures hair extension wefts to a wearer's hair or the thread may be used as a key component in constructing complete hair extension wefts, hair weaves, hair augmentation, and wigs.

Before the present compositions, methods, and methodologies are described, it is to be understood that this invention is not limited to particular compositions, methods, and conditions described, as such compositions, methods, and conditions may vary. It is also to be understood that the terminology used herein is for purposes of describing particular embodiments only, and is not intended to be limiting, since the scope of the present invention will be limited only in the appended claims.

As used in this specification and the appended claims, the singular forms "a", "an", and "the" include plural references unless the context clearly dictates otherwise. Thus, for example, references to "a hair extension weft" includes one or more hair extension wefts, and/or articles of manufacture of the type described herein which will become apparent to those persons skilled in the art upon reading this disclosure and so forth.

Unless defined otherwise, all technical and scientific terms used herein have the same meaning as commonly understood by one of ordinary skill in the art to which this invention belongs. Any methods and materials similar or equivalent to those described herein may be used in the practice or testing of the invention, as it will be understood that modifications and variations are encompassed within the spirit and scope of the instant disclosure.

As used herein, "about," "approximately," "substantially" and "significantly" will be understood by a person of ordinary skill in the art and will vary in some extent depending on the context in which they are used. If there are uses of the term which are not clear to persons of ordinary skill in the art given the context in which it is used, "about" and "approximately" will mean plus or minus <10% of particular term and "substantially" and "significantly" will mean plus or minus >10% of the particular term.

As used herein "an artificial hair integration article" is commonly known as a hair extension (rarely referred to as a "hair hat"), which articles add length and/or fullness to human hair.

As used herein "removably attaches" means something that is capable of being separated, lifted off or taken away from a material or surface after being secured to said material or surface by way of the methods and compositions as recited herein (e.g., removing a securing thread by chemical dissolution).

As used herein "individual" means a person or a specific object. For example, the methods and articles of the instant disclosure may be used on humans or animals in addition to hair mannequin heads, where the latter may serve as a way to teach hairdressing techniques.

As stated above, the amount of time and effort spent in the removal of sewn-in hair extensions, hair weaves, hair augmentation, or wigs from the person's natural hair is tedious and lengthy. Use of cutting instruments invariably results in the unintentional cutting of some of the wearer's own natural hair. Moreover, home remedies have been know to only provide temporary relief to scalp itch related to extension use. The compositions and processes as disclosed herein address those problems.

This instant disclosure provides professional hairdressers and wearers of hair extensions the ability to quickly remove all sewn-in hair extensions, weaves, hair augmentation, or wigs, with or without the use of cutting instruments.

The compositions and processes as disclosed herein differ from what currently exists, including that, unlike current methods in the hair care industry, the instant methods and materials afford the quick removal of sewn-in hair extensions via a dissolvable thread used to secure the hair extensions weft to a wearer's hair. In embodiments, the thread is configured to quickly react and dissolve when a dissolving agent is applied. Further, the dissolving agent may be applied in the form of an aerosol, foam, cream, gel, or liquid.

Constant scalp itching resulting from intimate contact with conventional hair extensions weft and thread material secured to the wearer's natural hair is also problematic. The compositions and processes as disclosed herein resolves issues related to extension removal and scalp itch through the use of a dissolvable thread in combination with a dissolving agent, where an added antipruritic having anti-itch properties provides additionally comfort to the wearer. The dissolvable thread may be used to either secure hair extension wefts to a wearer's hair or may be used in conjunction with a hair weft constructed of the same materials comprising the dissolvable thread.

Also, as disclosed herein, specific applicators may be used for both the supplemental antipruritic agent and the dissolving agent (e.g., but not limited to, a device where the antipruritic agent is stored in one chamber and the dissolving agent in another, where there is a common conduit for applying each agent alone or simultaneously; a device which comprises a comb-like structure for kneading the agent(s) into the scalp of the individual or seam of the weft), where each may be applied in the form of an aerosol, foam, cream, gel, or liquid.

In embodiments, components as disclosed herein may include, but are not limited to dissolvable thread, a supplemental antipruritic agent, and a dissolving agent.

Dissolvable Thread

Figure 4:
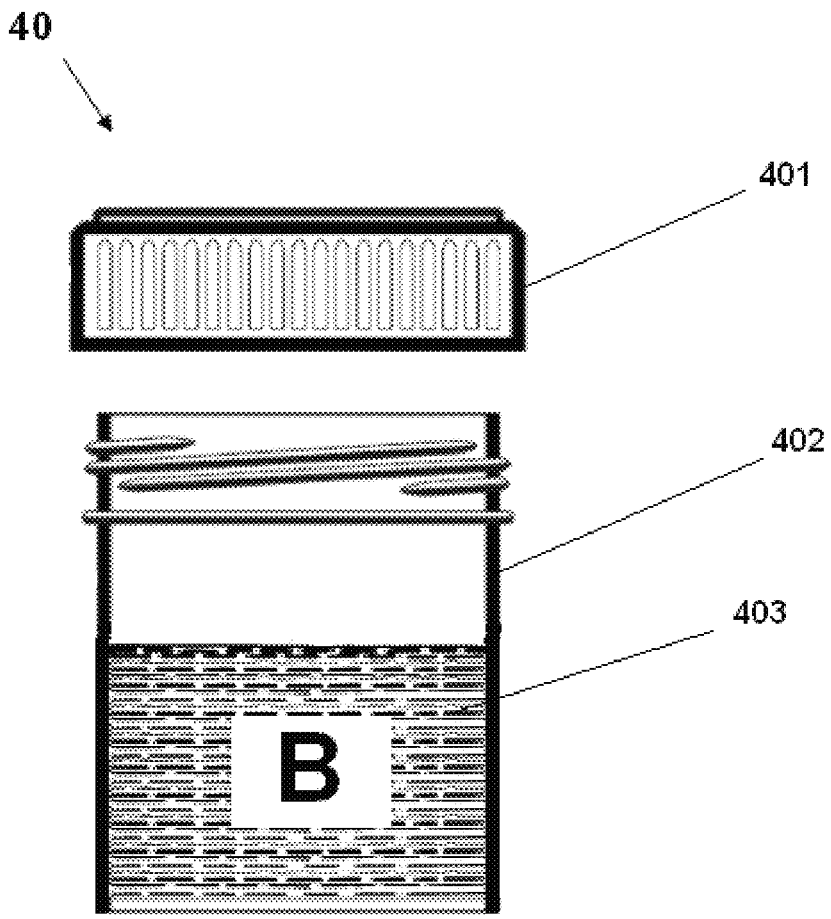
FIG. 4 shows a dissolving agent in a container (B), which agent is applied to dissolve the thread or wefts to quickly facilitate the removal of sewn-in hair extensions, hair weaves, hair augmentation, and wigs, including that the agent may be applied in the form of an aerosol, foam, cream, gel, or liquid.

Referring to FIG. 1, the dissolvable thread 102 is comprised of dissolvable, high strength, soluble materials (i.e., soluble in select solvents), may possess hypoallergenic properties and may contain antipruritic agents (incorporated therein), which thread 102 is configured to quickly dissolve when contacted with a select dissolving agent (403; FIG. 4). Scented or non-scented elements may be incorporated as well.

Figure 2:
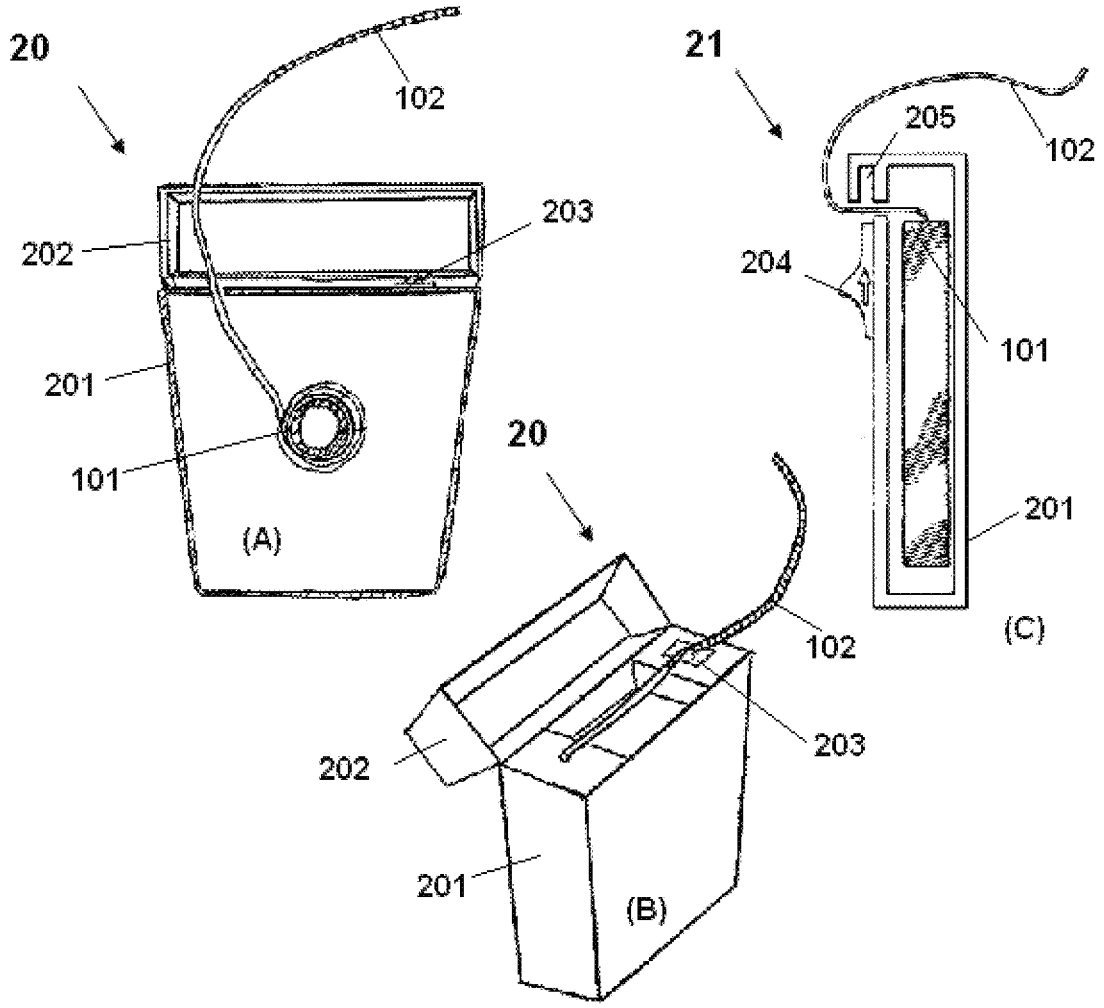
FIG. 2 shows various dispensers for the dissolvable thread: (A) and (B) illustrate a flip-top dispenser, where the thread may be cut by a sharp edge contained in an upper portion of the dispenser and the spool is perpendicular to the long axis of the dispenser; (C) shows another embodiment, where the thread is cut by a sliding sharp edge in an upper portion of the dispenser and the spool is parallel to the long axis of the dispenser.

The thread 102 may be made available on a spool 101 for easy dispensing. In embodiments, the spool 102 may be contained in a dispenser 20/21 (FIG. 2) comprising a housing 201, a lid 202, and a cutting or sharp edge 203 for cutting various lengths of dissolvable thread 102. In one embodiment (e.g., FIGS. 2 (A) and (B)), spool 101 may be perpendicular to the long axis of dispenser 20, and may contain sharp edge 203 at the top of the dispenser 20. In another embodiment, spool 101 may be parallel to the long axis of dispenser 21, and may contain a sliding cutting or sharp edge 204 on the front/top edge of the housing 201 which sliding edge 204 interacts with recess 205 to cut thread 102 via dispenser 21 (e.g., see FIG. 2(C)). The spool 102 in (C) may be secured to housing 201 using a rod (not shown) disposed through the center length of housing 201, anchored to the bottom thereof.

Figure 3:
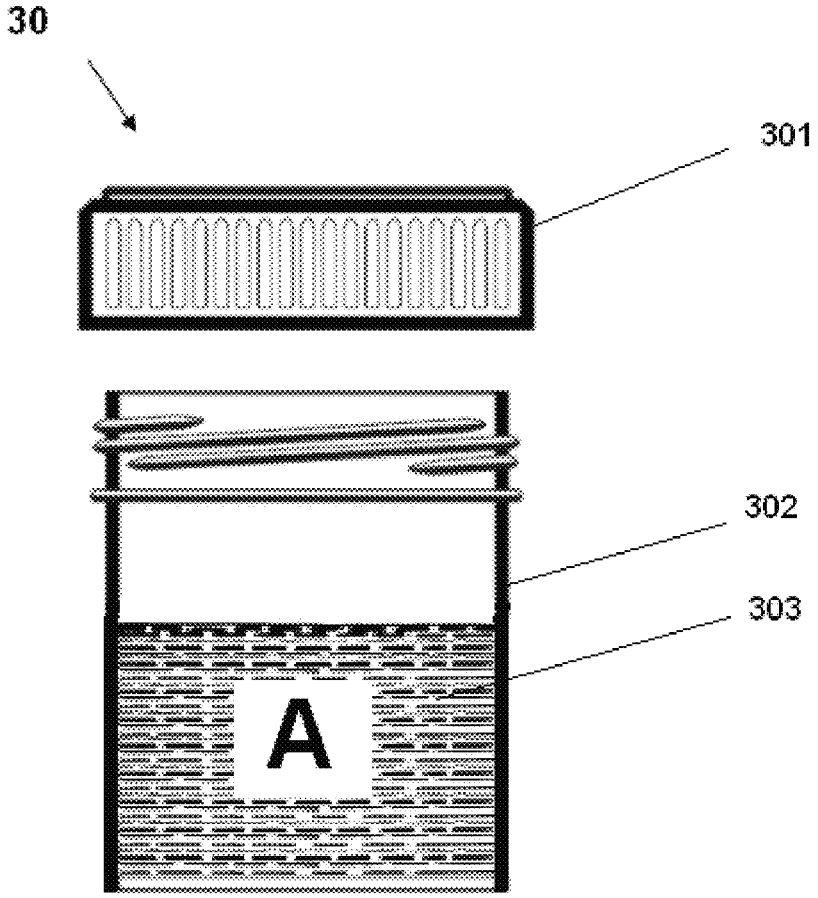
FIG. 3 shows a supplemental antipruritic agent in a container (A), which agent relieves itchiness from any previously installed hair extensions, hair weaves, hair augmentation, or wigs, including that such an agent may be applied in the form of an aerosol, foam, cream, gel, or liquid.
Figure 5:
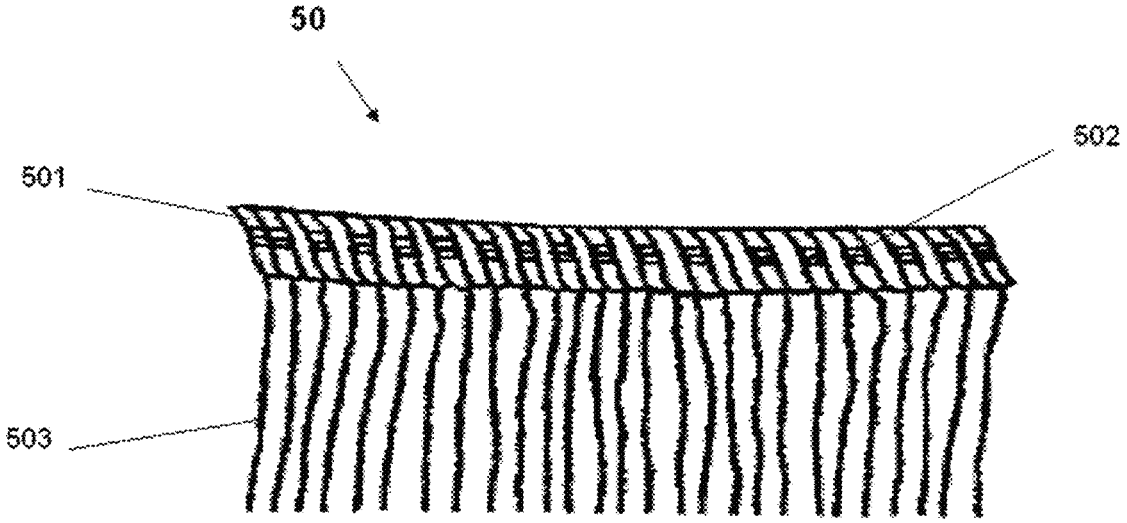
FIG. 5 shows a dissolvable weft which may be constructed from the dissolvable thread as disclosed herein to secure hair extensions, hair weaves, hair augmentation, or wigs to a wearer's hair, including that the weft may also contain an antipruritic agent to relieve any itching from installed hair extensions, hair weaves, hair augmentation, or wigs constructed therefrom.

Referring to FIGS. 1 and 4, elements required for the invention as disclosed include dissolvable thread 101 and the dissolving agent 403, which react with one another in order to rapidly dissolve either the thread 102 alone, or an entire hair extension weft 50 (FIG. 5) constructed from the dissolvable thread 102/502. Additional scents and colors are optional. The generic elements found in the supplemental antipruritic agent (e.g., 303, FIG. 3) may be important for enhancing the application and use of the dissolvable thread 102/502.

Figure 7:
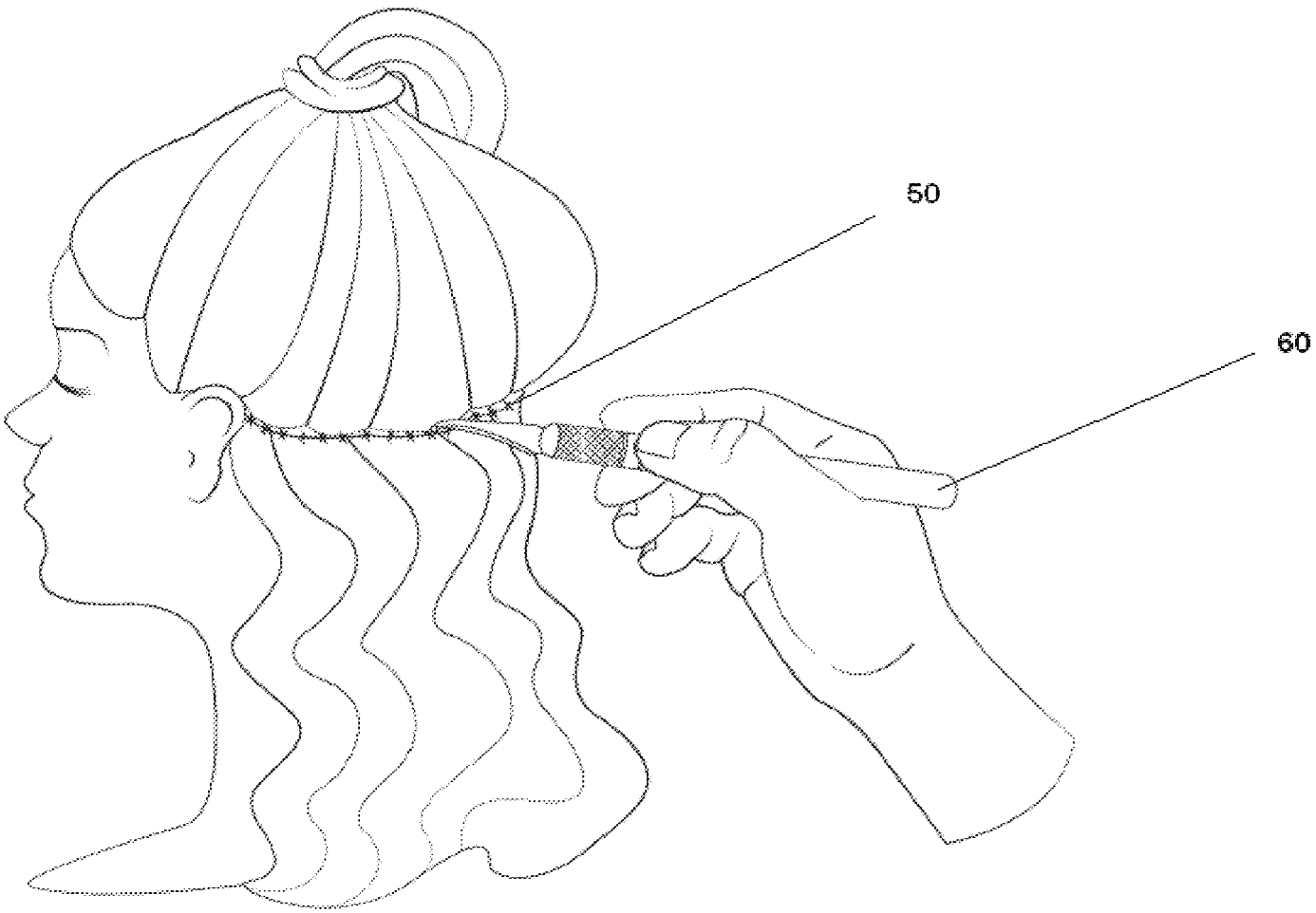
FIG. 7 shows an example of how to use a hair extensions thread removal tool with an extension weft.

The dissolvable thread 102/502 may be used to secure the hair extensions weft 50 to a wearer's hair (see, e.g., FIG. 7), and/or may be used to construct a hair extension weft 50 itself. In one aspect, the dissolving thread 102/502 includes chitosan.

Figure 10:
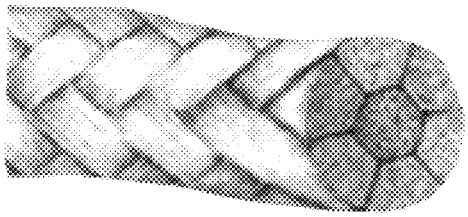
FIG. 10 shows a pre- (A) and post-coated (B) multi-stranded thread.
Figure 10:
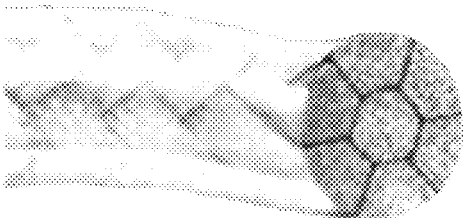

In embodiments, the chitosan used may be high molecular weight (i.e., at least about 200 kDa), however, other useful chitosan types may have molecular weights between about 3800 and about 20000 Da. In a related aspect, the chitosan may comprise chitosan microfibers, having a length of about 100 meters per spool, with a diameter of about 142 μm+/−0.003 μm, with a degree of acetylation (DA) of about 2%. Such a composition may have a shelf life of about 2 years, stored at between about 15° C. and 25° C. In embodiments, the thread may be uncoated or coated and multi-stranded (see, e.g., FIG. 10).

Dissolving Agent

Referring to FIG. 4, the dissolving agent 403 comprises compatible elements selected from biologically safe acids with hypoallergenic properties of which may be applied in the form of an aerosol, foam, cream, gel, or liquid. In embodiments, the dissolving agent 403 may be applied for about 10 to about 15 minutes, about 15 to about 20 minutes, about 20 to about 30 minutes, about 30 to about 45 minutes, about 45 to about 60 minutes or about 60 minutes to about 120 minutes. Higher concentrations of acid may be used to shorten application times, as long as such concentrations to not cause injury to the scalp. In one aspect, the amount of time applied may be dependent on the degree of acetylation (e.g., the lower the DA, the lower the application time). The dissolving may be carried out at least at room temperature or slightly higher, where higher temperatures may increase dissolving rate.

As disclosed herein, dissolving agents may alter or degrade the chitosan containing thread and may include, but are not limited to, weak organic acids. In embodiments, for chitosan, the amino groups (pKa from 6.2 to 7.0) are completely protonated in acids with pKa smaller than 6.2, making chitosan soluble in such acids. In a related aspect, the chitosan as disclosed herein is insoluble in water, organic solvents and aqueous bases, and it is soluble after stirring in acids such as acetic, lactic, nitric, hydrochloric, perchloric and phosphoric. In embodiments, the dissolving agent 403 may include acetic acid at a concentration of about 1.5 to about 2.5% (v/v), or about 2% (v/v). In one aspect, non-organic acids may be used at diluted strength (i.e., less than between about 1-2%). In another aspect, such non-organic acids may be combined with organic acids to product the dissolving agent.

The dissolving agent 403 may be applied to dissolve the dissolvable thread 102/502, which secures the weft 50 to quickly facilitate the removal of sewn-in hair extensions 503, hair weaves, hair augmentations, and wigs.

In embodiments, the dissolving agent 403 may be configured to dissolve absorbable sutures, or stitches, used in the medical field.

Supplemental Antipruritic Agent

The supplemental antipruritic agent 303 may be applied to hair extension wefts 50 to relieve itchiness resulting from any previously installed hair extensions, hair weaves, hair augmentation, or wigs.

Without being so limited, antipruritic agents include plant extracts, algae extracts, fruit extracts, vegetable extracts, leguminous plant extracts, ferments, proteolytic hydrolysates, peptides, yeast extracts and its derivatives, microorganism extracts, animal derivative extracts and synthetic compounds. More particularly, such agents may include thenaldine, trimeprazine, cyproheptadine. It also includes any combination thereof. In embodiments, the anti-itch formula as disclosed herein may include pure (100%) aloe vera, fractionally distilled liquid, mixed with lavender oil (e.g., about 8%). In one aspect, the anti-itch formula comprises about 92% aloe vera and about 8% lavender oil.

The supplemental antipruritic agent 303 may comprise generic anti-itch elements which may be applied in the form of an aerosol, foam, cream, gel, or liquid.

Figure 8:
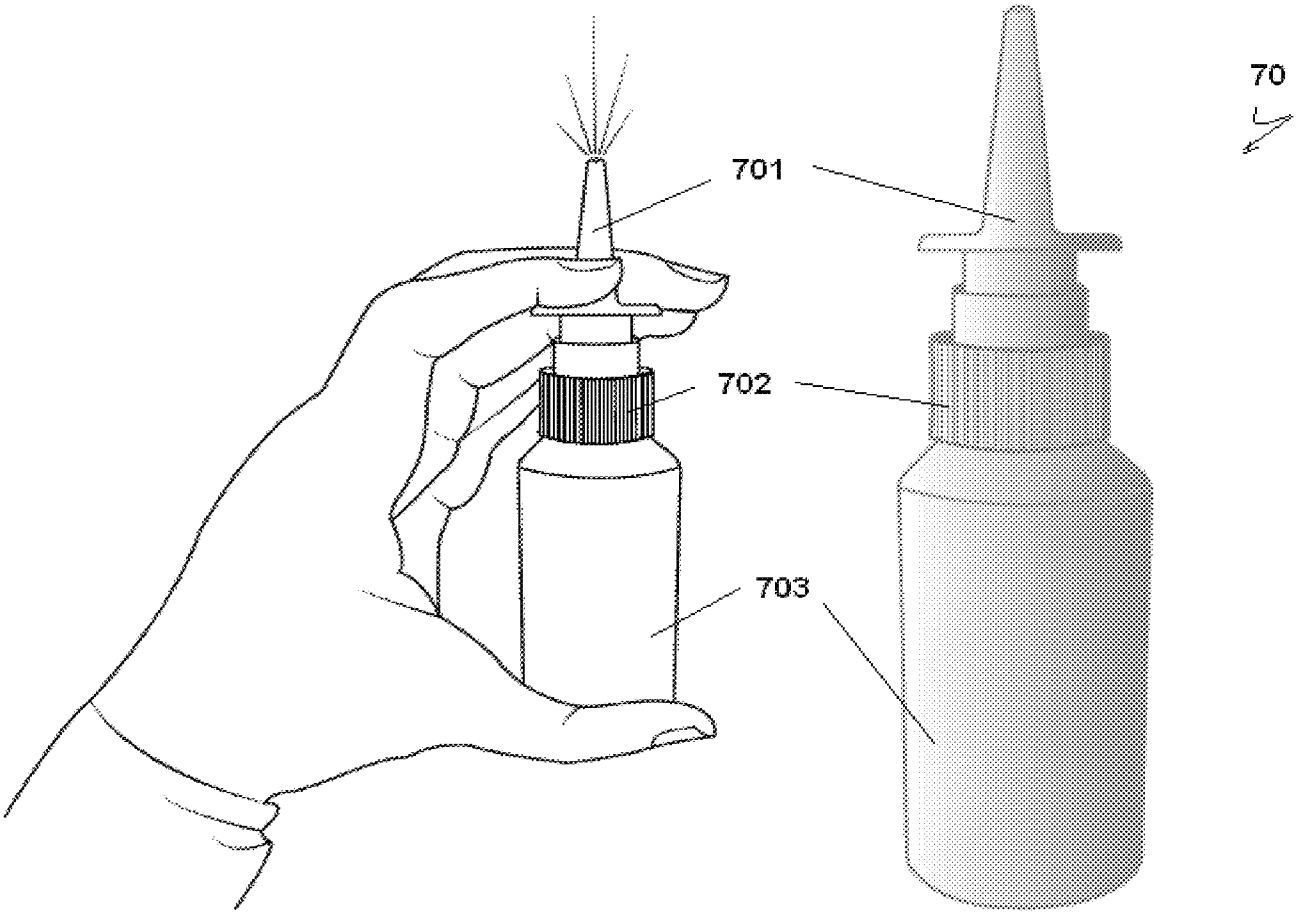
FIG. 8 illustrates an embodiment of the supplemental antipruritic agent applicator where the activator is integral with the spray unit.
Figure 9:
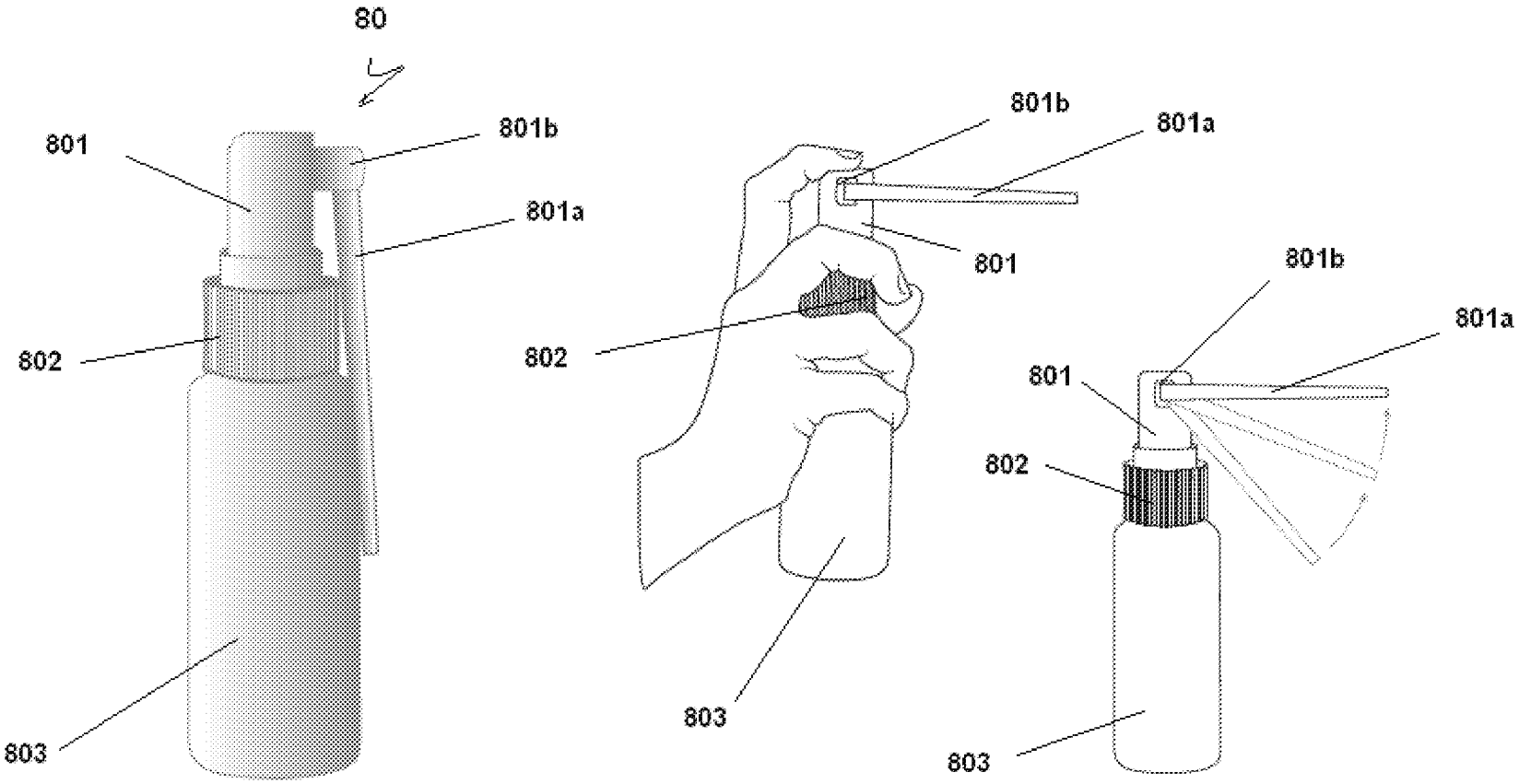
FIG. 9 illustrates another embodiment of the supplemental antipruritic agent applicator where a conduit is attached to the activator of the spray unit.

In one embodiment, the supplemental antipruritic agent may be applied using the spray applicator 70 as illustrated in FIG. 8, which figure shows a spray unit 701/702 which is configured to be releasably attached to container 703 through a collar 702, where the actuator 701 may allow for directing an amount of the agent to a specific area on the head of an individual. In another embodiment, the supplemental antipruritic agent may be applied using the spray applicator 80 as illustrated in FIG. 9, which figure shows a spray unit 801/801*a*/801*b*/802 which is configured to be releasably attached to container 803 through a collar 802, where the actuator 801 comprises a radially-adjustable conduit 801*a* which can rotate from a horizontal position that is perpendicular to the long axis of container 803 to a position 270° below said horizontal via housing 801*b*.

As will be apparent to one of skill in the art, the chemical compositions as disclosed herein may slightly vary without changing the overall effectiveness of said compositions, including that the actual application of the dissolving agent 403 and the supplemental antipruritic agent 303 may be varied by the shape of a physical applicator (e.g., but not limited to, a device where the antipruritic agent is stored in one chamber and the dissolving agent in another, where there is a common conduit for applying each agent alone or simultaneously; a device which comprises a comb-like structure for kneading the agent(s) into the scalp of the individual or seam of the weft).

Process and Methods of Use

The dissolvable thread 102/502 may be first used to secure hair extensions weft 50 to a wearer's hair, or dissolvable thread 102/502 may be used to construct the hair extensions weft 50 altogether. The supplemental antipruritic agent 303 may be applied to relieve any itchiness resulting from any previously installed hair extensions, hair weaves, hair augmentation, or wigs. The dissolving agent 403 may then be applied to quickly dissolve the dissolvable thread 102/502 to facilitate the removal of sewn-in hair extensions 503, hair weaves, hair augmentation, and wigs.

In embodiments, the following steps may be carried out to achieve the desired results as recited herein (refer to FIGS. 1-5):

Step 1. Use dissolvable thread 102 to sew the hair extensions weft 50 to a wearer's hair or may be used to construct the hair extensions weft 50.

Step 2. To relieve any itching, applying supplemental antipruritic agent 302 along the length of the wearer's braid (or weft seam 501), which braid (or weft seam 501) may be secured by said dissolvable thread 102/502.

Step 3. To remove hair extensions (weft 50), applying a dissolving agent 403 along the length of the wearer's braid (or weft seam 501), which braid (or weft seam 501) may be secured by the dissolvable thread 102/502.

Step 4. Gently pull or comb-out hair extensions (or seam 501) as threads 102/502 dissolve.

Figure 6:
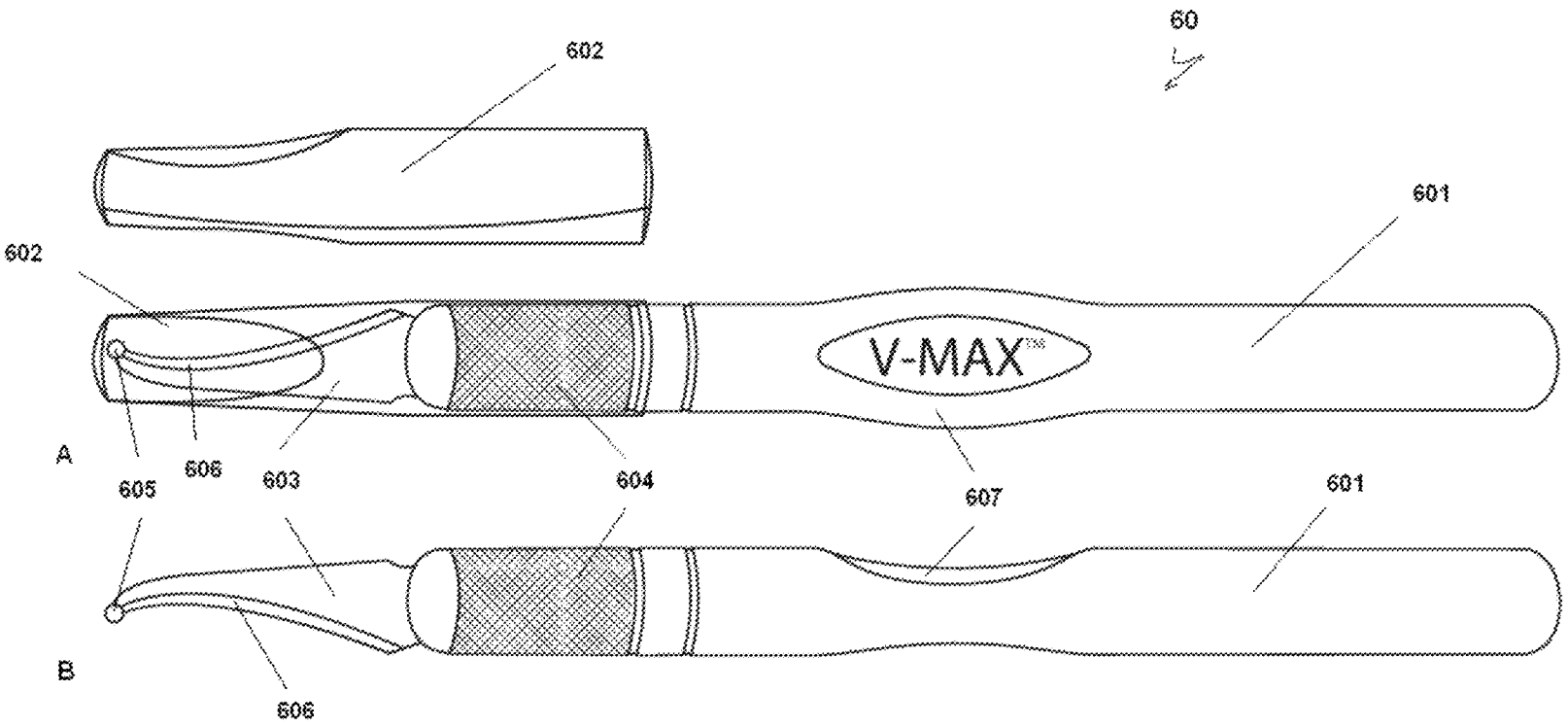
FIG. 6 illustrates a hair extensions thread removal tool showing the curved inner edge blade combined with an ergonomic handle: (A) shows the blade housed within a clear sheath and (B) shows the tool with the blade un-sheathed.

In embodiments, removal of the braid or weft 50 may be augmented by the use of a removal tool 60 as described herein (referring to FIG. 6). In a related aspect, the tool 60 includes an ergonomic handle 601 which houses curved inner edge blade 603/606. The curved inner edge 606 of blade 603 contains a molded plastic tip 605 (e.g., may be ball shaped, but other shapes are available as would be apparent to one of skill in the art). The tool 60 may be combined with a removable sheath 602 that is used to cover blade 603 when the tool 60 is not in use. The tool 60 also contains a knurled portion 604 for tightening and facile removal of the blade 603, including providing grip for delicate work, and a indentation 607, which may be used to control grip of the user.

In a further related aspect, the hair extensions thread removal tool 60 is used to safely and quickly cut the thread 102/502 which secures the weft 50, to facilitate the removal of sewn-in hair extensions 403, hair weaves, hair augmentations, and wigs.

In embodiments, the hair extensions thread removal tool 60 quickly isolates the strand of thread 102/502 which secures the hair extensions 503 along the length of the wefts 50 (i.e., seam 501) on a wearer's head. Once the thread 102/502 is isolated, a slight pulling-back, backward-and-forward (or bi-directional cutting motion), or pulling-up motion is all that is required to cut only the thread 102/502 and not the wearers' natural hair (referring to FIG. 7). Repeating these steps quickly facilitates the complete removal of sewn-in hair extensions 503, hair weaves, hair augmentation, and wigs.

The precision curved inner edge blade 603 is constructed to fit into the ergonomic handle 601 which is symmetrical such that the tool 60 may be used by both left-handed and right-handed users.

Quality control during the manufacturing and assembly process ensures that all outer edges are smooth and comfortable, and the curved inner edge 606 cutting blade is sharp.

In embodiments, the tool 60 may be used by following the steps below to achieve the desired results as recited herein (refer to FIGS. 5-7):

Step 1. Insert molded plastic tip 605 of tool 60 into top section 501 of hair weft 50 to isolate thread 502.

Step 2. Twist curved inner edge 606 cutting blade up to hook thread 502.

Step 3. Slightly pull hooked thread 502 either back, back-and-forwards (or a bi-directional cutting motion), or upwards to successfully cut thread 502.

Step 4. Repeat steps 1-3 and gently pull or comb-out hair extensions 503 as thread 502 is cut/dissolved.

In another aspect of the present disclosure, the compositions of the present agents may include a carrier. As used herein "carrier" describes a material that does not abrogate the activity and properties of the dissolving agent or antipruritic agent of the present disclosure. Carriers must be of sufficiently high purity and of sufficiently low toxicity to render them suitable for application to the individual. The carrier may be inert, or it may possess pharmaceutical benefits, cosmetic benefits or both.

Some non-limiting representative examples of carriers include moisturizing agents or humectants, pH adjusting agents, a deodorant agent, fragrances, hair conditioning agents, chelating agents, preservatives, emulsifiers, thickeners, solubilizing agents, penetration enhancers, anti-irritants, colorants and surfactants or combinations thereof.

As used herein a "moisturizing agent" is a substance that adds or restores moisture to the skin. Representative examples of moisturizing or humectant agents that are usable in the present compositions include, without limitation, guanidine, glycolic acid and glycolate salts (e.g., ammonium salt and quaternary alkyl ammonium salt), aloe vera in any of its variety of forms (e.g., aloe vera gel), allantoin, urazole, polyhydroxy alcohols such as sorbitol, glycerol, hexanetriol, propylene glycol, butylene glycol, hexylene glycol and the like, polyethylene glycols, sugars and starches, sugar and starch derivatives (e.g., alkoxylated glucose), hyaluronic acid, lactamide monoethanolamine, acetamide monoethanolamine and any combination thereof.

As is widely recognized in the art, since the pH of the skin is 5.5, compositions for topical skin application (to avoid irritation) should preferably have a pH value of between 4.0 and 7.0, preferably between 5.0 and 6.0, most preferably about 5.5 or substantially 5.5. Hence, a pH adjusting composition is typically added to bring the pH of the composition to the desired value. Some compositions of the present disclosure therefore preferably are formulated to have a pH value that ranges between about 4.0 and about 7.0, more preferably between about 5.0 and about 6.0.

Suitable pH adjusting agents include, for example, but are not limited to, one or more adipic acids, glycines, citric acids, calcium hydroxides, magnesium aluminometasilicates, buffers or any combinations thereof.

As used herein "deodorant agent" refers to a substance for inhibiting or masking perspiration or other bodily odors. Representative examples of deodorant agents that are usable in the context of the present disclosure include, without limitation, quaternary ammonium compounds such as cetyl-trimethylammonium bromide, cetyl pyridinium chloride, benzethonium chloride, diisobutyl phenoxy ethoxy ethyl dimethyl benzyl ammonium chloride, sodium N-lauryl sarcosine, sodium N-palmitoyl sarcosine, lauroyl sarcosine, N-myristoyl glycine, potassium N-lauryl sarcosine, stearyl, trimethyl ammonium chloride, sodium aluminum chlorohydroxy lactate, tricetylmethyl ammonium chloride, 2,4,4'-trichloro-2'-hydroxy diphenyl ether, diaminoalkyl amides such as L-lysine hexadecyl amide, heavy metal salts of citrate, salicylate, and piroctose, especially zinc salts, and acids thereof, heavy metal salts of pyrithione, especially zinc pyrithione and zinc phenolsulfate. Other deodorant agents include, without limitation, odor absorbing materials such as carbonate and bicarbonate salts, e.g., as the alkali metal carbonates and bicarbonates, ammonium and tetraalkylammonium carbonates and bicarbonates, especially the sodium and potassium salts, or any combination of the above.

As used herein "fragrance" refers to a substance having a pleasant aroma. Suitable fragrances include, but are not limited to, eucalyptus oil, camphor synthetic, peppermint oil, clove oil, lavender, chamomile and the like.

Suitable hair conditioning agents that may be used in the context of the present disclosure include, for example, one or more collagens, cationic surfactants, modified silicones, proteins, keratins, dimethicone polyols, quaternary ammonium compounds, halogenated quaternary ammonium compounds, alkoxylated carboxylic acids, alkoxylated alcohols, alkoxylated amides, sorbitan derivatives, esters, polymeric ethers, glyceryl esters, or any combinations thereof.

Chelating agents are optionally added to the compositions of the present disclosure so as to enhance the preservative or preservative system. Preferred chelating agents are mild agents, such as, for example, ethylenediaminetetraacetic acid (EDTA), EDTA derivatives (e.g., salts, fatty acid conjugates), or any combination thereof.

Suitable preservatives for use in the present compositions include, without limitation, one or more alkanols, disodium EDTA (ethylenediamine tetraacetate), EDTA salts, EDTA fatty acid conjugates, isothiazolinone, parabens such as methylparaben and propylparaben, propylene glycols, sorbates, urea derivatives such as diazolindinyl urea, or any combinations thereof.

As used herein, an "anti-irritant" is an agent that prevents or reduces soreness, roughness, or inflammation of a bodily part. Suitable anti-irritants that may be used in the context of the present disclosure include, for example, steroidal and non steroidal anti-inflammatory agents or other materials such as aloe vera, chamomile, alpha-bisabolol, cola nitida extract, green tea extract, tea tree oil, licorice extract, allantoin, caffeine or other xanthenes, glycyrrhizic acid and its derivatives. In embodiments, the anti-itch formula as disclosed herein may include pure (100%) aloe vera, fractionally distilled liquid, mixed with lavender oil (e.g., about 8%). In one aspect, the anti-itch formula comprises about 92% aloe vera and about 8% lavender oil.

The presently known anti-irritants may be divided into water-soluble anti-irritants and water-insoluble anti-irritants. Representative examples of such compositions are described, for example, in U.S. Pat. No. 5,482,710, which is herein incorporated by reference.

Colorants may also be used in the compositions of the present disclosure. Colorants include pigments or dyes or a combination thereof as the cosmetic benefit requires. Pigments include, but are not limited to, iron oxides, and titanium oxides. Suitable dyes include FD&C approved colorants, D&C approved colorants, and those approved for use in Europe and Japan. See Marmion, D. M., Handbook of US Colorants for Food, Drugs, Cosmetics, and Medical Devices, 3rd ed, 1991 herein incorporated by reference.

"Surfactants" as used herein are surface-active substances, such as a detergent. Suitable surfactants for use with the present compositions include, but are not limited to, sarcosinates, glutamates, sodium alkyl sulfates, ammonium alkyl sulfates, sodium alkyleth sulfates, ammonium alkyleth sulfates, ammonium laureth-n-sulfates, sodium laureth-n-sulfates, isothionates, glycerylether sulfonates, sulfosuccinates and combinations thereof. The anionic surfactant may be selected from the group consisting of sodium lauroyl sarcosinate, monosodium lauroyl glutamate, sodium alkyl sulfates, ammonium alkyl sulfates, sodium alkyleth sulfates, ammonium alkyleth sulfates, and combinations thereof.

In embodiments, the supplemental dissolving agent and/or antipruritic agent may be mixed with a gel suspension, (a semi-solid carrier) or solid carrier to form a paste, powder, ointment, cream, lotion, hydrogel or the like.

For example, ointments may be prepared which are in gel-suspension form. These are semi-solid preparations intended for external application to the epithelium. Generally, ointment bases are categorized into hydrocarbon bases (oleaginous), which may use white petroleum as a base; adsorption bases (anhydrous), which might use hydrophilic petroleum or anhydrous lanolin; emulsion bases (water and oil type); emulsion bases (oil and water type); and water soluble bases, which often use polyethylene glycol as an ointment base.

Additional components of the present compositions using disclosed compounds and carriers may be readily prepared using technology which is known in the art such as described in Remington's Pharmaceutical Sciences, $18^{th}$ or $19^{th}$ editions, published by the Mack Publishing Company of Easton, Pa., herein incorporated by reference.

In embodiments, a kit is also disclosed herein. Referring to FIGS. 1-9, the kit may comprise at least one hair extension weft 50; a spool 101 or other dispenser 10/20/21 of dissolvable thread 102 (as will be apparent to one of skill in the art) for interweaving through one or more positions along the length of a seam 501 of the hair extension weft 50; an optional needle (curved or straight), a dissolving agent 403, where the agent 403 dissolves the thread 102; optionally an antipruritic agent 303; a first set of containers for the agents 30/40; optionally a set of thread dispenser; instructions; and one or more labels.

In one aspect, the kit may include a thread removal tool 60 as described herein.

In embodiments, instructions may be included in the kit or a label may direct a user to an internet address where instructions may be found.

All references recited are incorporated herein by reference in their entireties.

Although the invention has been described with reference to the above, it will be understood that modifications and variations are encompassed within the spirit and scope of the invention. Accordingly, the invention is limited only by the following claims.

We claim herein:

1. An artificial hair integration article comprising:

a) a hair extension weft and b) a dissolvable thread interwoven through one or more positions along the length of a seam of said hair extension weft, wherein said dissolvable thread removably attaches said weft to a section of natural hair or a wig cap on the head of an individual.

2. The artificial hair integration article of claim 1, wherein said dissolvable thread is insoluble in water, shampoo containing aqueous bases or organic solvents, or combinations thereof, and wherein the interwoven dissolvable thread is optionally secured to at least one end of said weft seam by one or more knots.

3. The artificial hair integration article of claim 1, wherein the dissolvable thread is interwoven through said natural hair or wig cap at positions along said seam to secure said weft to the head of the individual.

4. The artificial hair integration article of claim 1, wherein said dissolvable thread comprises a linear or branched polysaccharide.

5. The artificial hair integration article of claim 1, wherein said linear polysaccharide is a chitosan.

6. The artificial hair integration article of claim 1, wherein said weft comprises natural hair, synthetic fibers or a combination thereof.

7. The artificial hair integration article of claim 6, wherein the synthetic fibers and dissolvable thread comprise the same material.

8. The artificial hair integration article of claim 5, wherein the rate at which the thread dissolves is dependent on the degree of acetylation (DA) of the chitosan.

9. The artificial hair integration article of claim 8, wherein the DA of the chitosan is between about 2% to about 10%, and wherein said dissolvable thread may be removed from said weft, natural hair or wig cap by application of an acid with a pKa of less than about 6.2.

10. A method of removing one or more artificial hair integration articles from the head of an individual, wherein the individual has at least one hair extension weft secured to the natural hair or wig cap on the head of thereof via a dissolvable thread interwoven through one or more positions along the length of a seam of said at least one hair extension weft, comprising;

a) applying an antipruritic agent along the length of the seam;
b) applying a dissolving agent along the length of the seam; and
c) pulling or combing-out hair extension wefts as the dissolvable threads dissolve;

wherein steps (b)-(c) are repeated until all of the at least one artificial hair integration articles are removed, and wherein the dissolvable thread comprises chitosan.

11. The method of claim 10, wherein the dissolving agent and/or the dissolving thread comprise an antipruritic agent.

12. The method of claim 10, wherein step (c) comprises application of a thread removal tool, which thread removal tool contains:

i) a handle and
ii) a sharp curved inner edge blade at one end of the handle, wherein said curved inner edge blade is housed within a non-sharp outer edge and blunt tip.

13. The method of claim 12, further comprising:

d) inserting the blunt tip of said tool into the seam of the hair extension weft to isolate the dissolving thread;
e) twisting the curved inner edge cutting blade up to hook the dissolving thread;
f) pulling the hooked thread either back or upwards, or cutting said thread bi-directionally, wherein said pulling or cutting disengages the dissolving thread from the hair extensions weft;
g) repeat steps (d)-(f) and
h) pulling or combing-out hair extensions as the thread is disengaged.

14. The method of claim 10, further comprising rinsing the head of the individual to remove the antipruritic agent and the dissolving agent.

15. The method of claim 10, wherein the antipruritic agent is applied as an aerosol, foam, cream, gel, or liquid.

16. The method of claim 10, wherein the dissolving agent is applied as an aerosol, foam, cream, gel, or liquid.

17. A kit for applying to and removing an artificial hair integration article from the head of an individual comprising:

a) at least one hair extension weft;
b) a spool of dissolvable thread for interweaving through one or more positions along the length of a seam of said hair extension weft;
c) a dissolving agent, wherein said agent dissolves said thread;
d) an antipruritic agent;
e) a first set of containers for said agents;
f) instructions; and
g) one or more labels.

18. The kit of claim 17, wherein the dissolvable thread comprises chitosan.

19. The kit of claim 17, wherein the agents being selected from the group consisting of an aerosol, foam, cream, gel, or liquid, or a combination thereof.

20. The kit of claim 17, wherein the kit further comprises a thread removal tool, which thread removal tool contains:

i) a handle and
ii) a sharp curved inner edge blade at one end of the handle, wherein said curved inner edge blade is housed within a non-sharp outer edge and blunt tip.

* * * * *